US010188166B2

(12) United States Patent
Zimmer

(10) Patent No.: US 10,188,166 B2
(45) Date of Patent: Jan. 29, 2019

(54) HELMET MOUNTED LIGHTING SYSTEM

(71) Applicant: Trent Zimmer, Houma, LA (US)

(72) Inventor: Trent Zimmer, Houma, LA (US)

( * ) Notice: Subject to any disclaimer, the term of this patent is extended or adjusted under 35 U.S.C. 154(b) by 51 days.

(21) Appl. No.: 15/264,626

(22) Filed: Sep. 14, 2016

(65) Prior Publication Data

US 2017/0071279 A1 Mar. 16, 2017

Related U.S. Application Data

(60) Provisional application No. 62/218,085, filed on Sep. 14, 2015.

(51) Int. Cl.

| | |
|---|---|
| ***A42B 3/00*** | (2006.01) |
| ***A42B 3/04*** | (2006.01) |
| ***F21L 4/00*** | (2006.01) |
| ***F21V 23/02*** | (2006.01) |
| *F21V 23/04* | (2006.01) |
| *F21V 23/00* | (2015.01) |
| *F21V 21/08* | (2006.01) |

(52) U.S. Cl.

CPC ..... *A42B 3/044* (2013.01); *A42B 3/0453* (2013.01); *F21L 4/00* (2013.01); *F21V 23/023* (2013.01); *F21V 21/0808* (2013.01); *F21V 23/005* (2013.01); *F21V 23/0414* (2013.01)

(58) Field of Classification Search

CPC ..... A42B 3/044; A42B 3/0453; F21L 4/00; F21V 23/023; F21V 21/0808; F21V 23/005; F21V 23/0414

USPC ..... 362/105

See application file for complete search history.

(56) References Cited

U.S. PATENT DOCUMENTS

| | | | | |
|---|---|---|---|---|
| 4,665,568 A * | 5/1987 | Stutes | A42B 1/004 | 362/105 |
| 5,758,947 A * | 6/1998 | Glatt | A42B 3/044 | 362/106 |
| 6,325,521 B1 * | 12/2001 | Gregg | A42B 3/044 | 362/106 |
| 6,328,454 B1 * | 12/2001 | Davis | A42B 3/044 | 362/105 |
| 8,444,291 B2 | 5/2013 | Swan et al. | | |
| 8,908,389 B2 * | 12/2014 | Teetzel | F41H 1/04 | 2/205 |

* cited by examiner

*Primary Examiner* — Anh Mai
*Assistant Examiner* — Meghan Ulanday
(74) *Attorney, Agent, or Firm* — F. Wayne Thompson, Jr.; Asgaard Patent Services, LLC

(57) ABSTRACT

Implementations of a helmet mounted lighting system are provided. In some implementations, the lighting system may be mounted to a helmet, hard hat, and/or other type of protective headwear. In some implementations, the lighting system acts as a safety device when mounted to a protective headwear by providing illumination which serves as a visual indicator of the wearer's presence and/or location. In some implementations, the lighting system may comprise a mounting plate, a cover, a battery, and a printed circuit board (PCB). In some implementations, the PCB may comprise a logic board, one light emitting diode (LED), a capacitor, and/or a switch. Together, the mounting plate and cover form a housing that encases the battery and the PCB. In some implementations, the bottom side of the mounting plate may be contoured for attachment to the curved exterior surface of a protective headwear.

13 Claims, 6 Drawing Sheets

HELMET MOUNTED LIGHTING SYSTEM

CROSS REFERENCE TO RELATED APPLICATION

This application claims the benefit of U.S. Provisional Application Ser. No. 62/218,085, filed on Sep. 14, 2015, and is incorporated herein by reference in its entirety.

TECHNICAL FIELD

This disclosure relates to implementations of a helmet mounted lighting system.

BACKGROUND

A helmet is a form of protective gear worn to protect the head from injuries. Attaching a light source to a helmet is well known in the prior art. In general, a light source is affixed to a helmet for activities such as hiking, caving, mining, and other activates were a user may want or need hands-free lighting. A helmet mounted light source may also serve as a visual indicator of a wearer's presence and thereby act as a safety device.

Therefore, there is a need for a helmet mounted lighting system that may be securely mounted on a helmet or other type of protective headwear.

SUMMARY OF THE INVENTION

Implementations of a helmet mounted lighting system are provided. In some implementations, the lighting system may be mounted to a helmet, hard hat, and/or other type of protective headwear. In some implementations, the lighting system acts as a safety device when mounted to a helmet, hard hat, and/or other type of protective headwear by providing illumination which serves as a visual indicator of the wearer's presence and/or location.

In some implementations, the lighting system may comprise a battery, a mounting plate, a printed circuit board (PCB), and a cover. In some implementations, the PCB may comprise a logic board, one light emitting diode (LED), a capacitor, and a switch thereon. Together, the mounting plate and the cover form a housing for the battery and the PCB.

In some implementations, the bottom side of the mounting plate may be contoured to fit against the curved exterior surface of a protective headwear. In some implementations, the bottom side of the mounting plate may be configured to fit flush against the curved exterior surface of a protective headwear.

In some implementations, the top side of the mounting plate may include a receptacle thereon configured to receive the battery therein. In some implementations, the receptacle is configured to prevent the lateral movement of the battery and the connected PCB.

In some implementations, the switch may be toggled by pressing on the flexible cover of the housing until it makes contact with the switch. In this way, the user may selectively energize the LED and/or the electronic circuit as a whole.

In some implementations, the cover may be transparent or translucent. In this way, the LED may be visible when illuminated.

In some implementations, the LED may be conductively connected to the battery, the logic board, the switch, and the capacitor through the PCB. In some implementations, the PCB may include more than one LED thereon, for example three LEDs.

In some implementations, the logic board may be configured to control the operation of the LED conductively connected to the switch. In some implementations, one or more programs used to control the operation of the LED may be stored in the memory of the logic board. In some implementations, a program may control the frequency and the duration of the LED's operation. For example, a program may be used to turn the LED on or off, or cause the LED to flash intermittently (i.e., strobe). In some implementations, the switch may be used to select and/or initiate a program stored in the memory of the logic board and thereby control the operation of the LED. In some implementations, the logic board may not be programmable.

In some implementations, an LED may emit a white light when energized. In some implementations, an LED may emit a colored light (e.g., red, blue, green, etc.) when energized. In some implementations, an LED may emit an infrared light when energized. In this way, the light may only be visible to a third party utilizing a device capable of seeing infrared light (e.g., a night vision device).

DETAILED DESCRIPTION

FIGS. 1-7 illustrate an example helmet mounted lighting system 100 according to the present disclosure. In some implementations, the lighting system 100 may be mounted to a helmet, hard hat, and/or other type of protective headwear 50 (see, e.g., FIG. 7). In some implementations, the lighting system 100 acts as a safety device when mounted to a helmet, hard hat, and/or other type of protective headwear by providing illumination which serves as a visual indicator of the wearer's presence and/or location.

Figure 4:
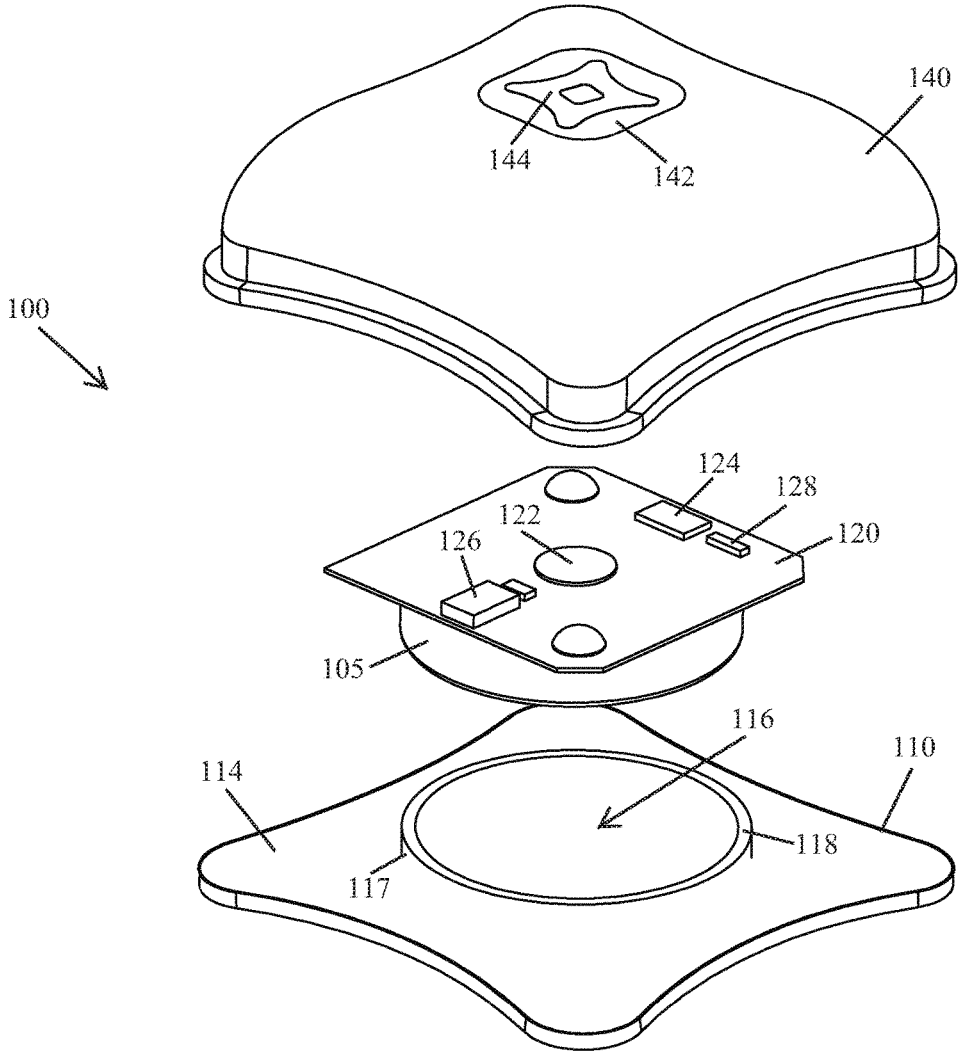
FIG. 4 illustrates an exploded view of the helmet mounted lighting system shown in FIG. 1.

As shown in FIG. 4, in some implementations, the lighting system 100 may comprise a battery 105, a mounting plate 110, a printed circuit board (PCB) 120, and a cover 140. In some implementations, the PCB 120 may comprise a logic board 126, one light emitting diode (LED) 124, a capacitor 128, and/or a switch 122 thereon (see, e.g., FIG. 1A). In some implementations, the mounting plate 110 and cover 140 together form a housing that encases the battery 105 and the PCB 120.

Figure 1:
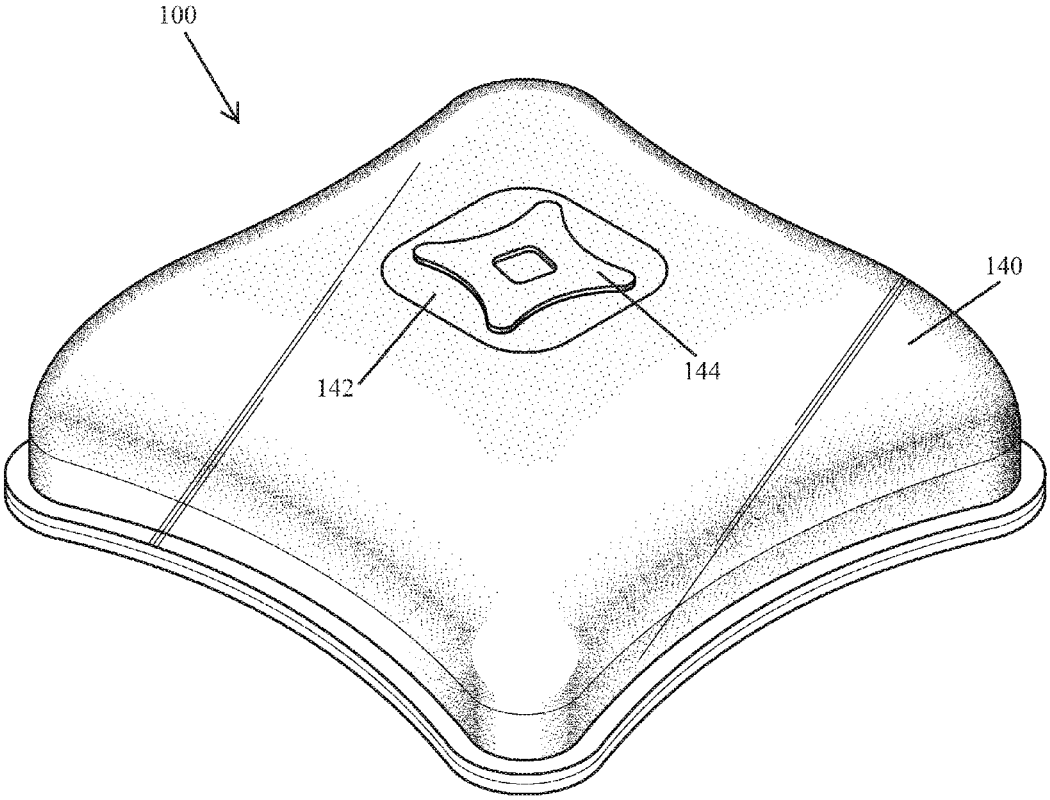
FIG. 1 illustrates a top perspective view of a helmet mounted lighting system according to the principles of the present disclosure.
Figure 2:
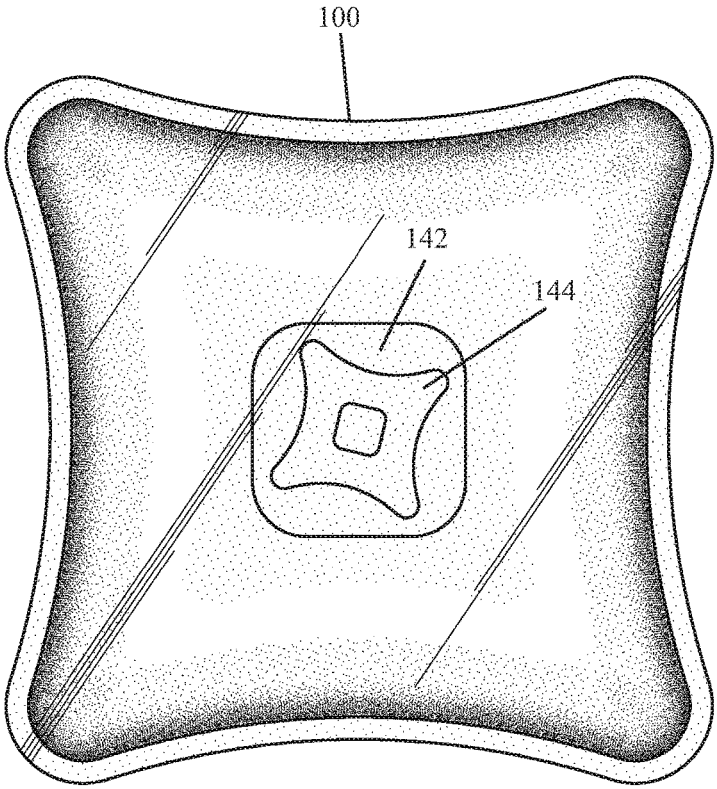
FIG. 2 illustrates a top view of the helmet mounted lighting system shown in FIG. 1.
Figure 3:
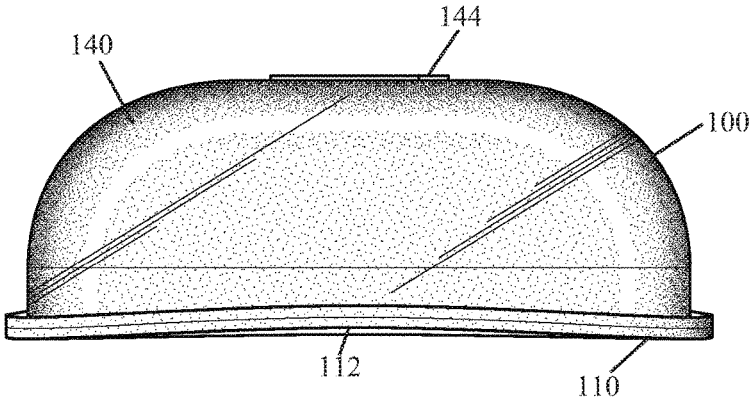
FIG. 3 illustrates a side elevation view of the helmet mounted lighting system shown in FIG. 1.

As shown in FIGS. 1, 3, and 4, in some implementations, the cover 140 may be dome shaped thereby defining an interior space. In this way, the battery 105 and the PCB 120 may be housed within the interior space of the cover 140. In some implementations, the cover 140 may have an indentation 142 thereon (see, e.g., FIGS. 1 and 2). In some implementations, the indentation 142 may be centrally located on the cover 140 (see, e.g., FIG. 1). In some implementations, the indentation 142 may not be centrally located on the cover 140. In some implementations, the cover 140 may not have an indentation 142 thereon.

In some implementations, the indentation 142 may have indicia 144 or other symbol therein (see, e.g., FIGS. 1 and 2). In some implementations, the indicia 144 may protrude above the exterior surface of the cover 140 (see, e.g., FIG. 3).

As shown in FIG. 3, in some implementations, the cover 140 may be configured to be secured to the mounting plate 110. In some implementations, the cover 140 may be fused to the mounting plate 110 thereby sealing the battery 105 and PCB 120 therein. In this way, the cover 140 and the mounting plate 110 may be assembled to form a water proof housing that encases the battery 105 and the PCB 120.

In some implementations, the cover 140 may be transparent or translucent. In this way, the LED 124 may be visible when illuminated.

As shown in FIGS. 3 and 4, in some implementations, the mounting plate 110 of the lighting system 100 has a bottom side 112 and a top side 114.

Figure 7:
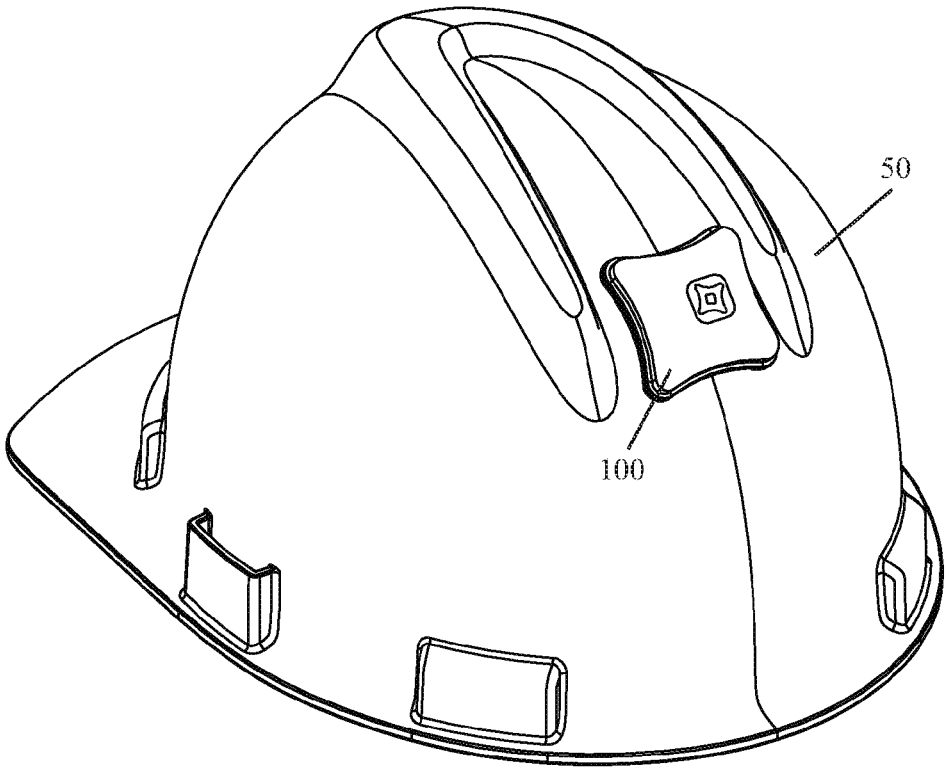
FIG. 7 illustrates a helmet mounted lighting system secured to the backside of an example helmet in according to the principles of the present disclosure.

In some implementations, the bottom side 112 of the mounting plate 110 of the lighting system 100 may be contoured for attachment to the curved exterior surface of a helmet 50, hardhat, and/or other type of protective headwear (see, e.g., FIG. 7). In some implementations, the bottom side 112 of the mounting plate 110 may be configured to fit flush, or nearly flush, with the curved exterior surface of a protective headwear. In some implementations, the bottom side 112 of the mounting plate 110 may be flat (not shown). In some implementations, hook and loop fasteners (e.g., Velcro®) may be used to removably secure the bottom side 112 of the mounting plate 110, and thereby the lighting system 100, to the exterior of a helmet, hardhat, and/or other type of protective headwear. In some implantations, an adhesive may be used to secure the bottom side 112 of the mounting plate 110 to the exterior of a helmet, hardhat, and/or other type of protective headwear. In some implementations, a peel-off liner may be used to cover the adhesive on the bottom side 112 of the mounting plate 110 to protect it until the lighting system 100 is mounted on a helmet.

As shown in FIG. 4, in some implementations, the top side 114 of the mounting plate 110 may include a receptacle 116 thereon that is configured to receive the battery 105 therein. In this way, lateral movement of the battery 105 may be prevented. In some implementations, the receptacle 116 may comprise a cylindrical side wall 117 extending upwardly from the top side 114 of the mounting plate 110. In some implementations, the top side of the cylindrical side wall 117 may include an annular ledge 118 thereon (see, e.g., FIG. 4). In some implementations, the opening defined by the cylindrical side wall 117 is configured to receive the battery 105 therein and the annular ledge 118 is configured so that at least a portion of the PCB 120 may rest thereon.

In some implementations, the cover 140 and the mounting plate 110 may be manufactured from a flexible silicon rubber. In some implementations, the cover 140 and the mounting plate 110 may be manufactured from any suitably flexible material. In some implementations, the cover 140 and the mounting plate 110 may be manufactured from different materials.

Figure 5:
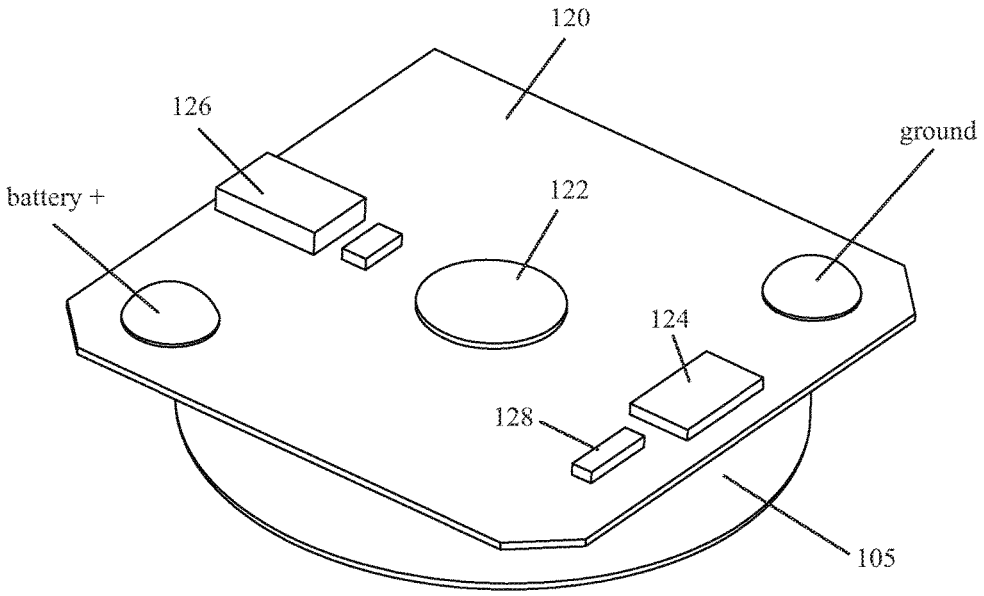
FIG. 5 illustrates a printed circuit board (PCB) and battery according to the principles of the present disclosure.

As shown in FIG. 5, in some implementations, the PCB 120 may have the general shape of a square. In some implementations, the PCB 120 may be any shape or dimension suitable for being received within the interior space formed between the mounting plate 110 and the cover 140 of the lighting system 100.

Figure 6:
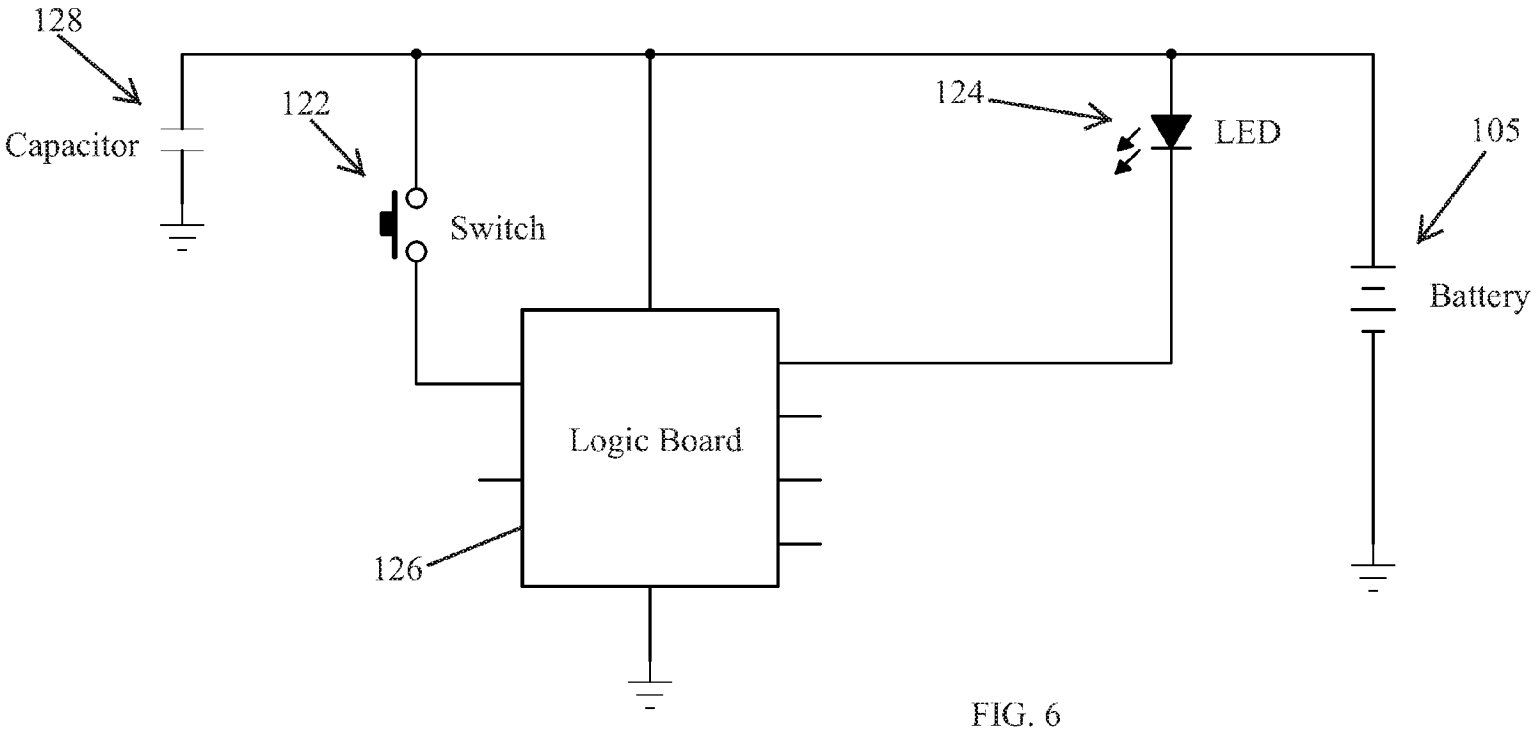
FIG. 6 illustrates an example schematic view of the electronic circuit of the helmet mounted lighting system according to the principles of the present disclosure.

In some implementations, the LED 124 may be conductively connected to the power source 105 (e.g., a battery), the logic board 126, the switch 122, and the capacitor 128 through the PCB 120 (see, e.g., FIG. 6). In some implementations, the switch 122 may be used to selectively energize the LED 124 on the PCB 120. In some implementations, the PCB 120 may include more than one LED 124 thereon, for example three LEDs.

In some implementations, the switch 122 may be positioned on a top side of the PCB 120 so that it is below the indentation 142 of an assembled lighting system 100 (see, e.g., FIG. 4). In this way, the user may toggle the switch 122 by pressing the indentation 142 and/or indicia 144 of the flexible cover 140 inwardly until the interior side of the cover 140 makes contact with the switch 122. In some implementations, the switch 122 is configured to selectively energize the LED 124 and/or the electronic circuit as a whole (see, e.g., FIG. 6). In some implementations, the switch 122 may be a dome type switch. In some implementations, any switch type suitable for use as part of the lighting system 100 disclosed herein may be used. In some implementations, the switch 122 may be located in the center of the PCB 120 (see, e.g., FIG. 5). In some implementations, the switch 122 may be positioned on the PCB 120 in any suitable location.

In implementations of the lighting system 100 without an indentation 142 and/or indicia 144 on the cover 140, the user simply presses the flexible cover 140 inwardly until the interior side of the cover 140 makes contact with the switch 122.

In some implementations, the logic board 126 may be configured to control the operation of the LED 124 conductively connected to the switch 122. In some implementations, the logic board 126 may be conductively connected to an energy source, for example, the battery 105 secured to the PCB 120 (see, e.g., FIG. 5).

In some implementations, the logic board 126 may be programmable. In some implementations, one or more programs used to control the operation of the LED 124 may be stored in the memory of the logic board 126. In some implementations, a program may control the frequency and the duration of the LED's 124 operation. For example, a program may be used to turn the LED 124 on or off, or cause the LED 124 to flash intermittently (i.e., strobe). In some implementations, the switch 122 may be used to select and/or initiate a program stored in the memory of the logic board 126 and thereby control the operation of the LED 124. In some implementations, the logic board 126 may not be programmable. Methods of constructing and/or selecting a logic board 126 to control the operation of the LED 124 conductively connected to the PCB 120 would be known to one of ordinary skill in the art.

In some implementations, the electronic circuitry (e.g., the PCB 120) may not include a logic board 126. In this case, the LED 124 may be toggled on and off using the switch 122.

In some implementations, the capacitor 128 may be configured to regulate the light output (e.g., lumens) of the LED 124. In some implementations, the capacitor 128 may be configured to ensure a consistent light output (e.g., lumens) by the LED 124 during the entire service life of a battery 105. In this way, the lighting system 100 may have a known service life. By knowing the service life of a battery 105 and thereby the lighting system 100, the lighting system 100 may be replaced on a predictable schedule. One of ordinary skill in the art having the benefit of the present disclosure would know how to select an appropriate capacitor 128. In some implementations, the electronic circuitry (e.g., the PCB 120) may not include a capacitor 128.

In some implementations, the battery 105 and the PCB 120 may be fused together inside and positioned inside of the housing of the lighting system 100. In this way, the lighting system 100 may be disposable. In some implementations, the battery 105 may be removable from the PCB 120.

In some implementations, an LED 124 may emit a white light when energized. In some implementations, an LED 124 may emit a colored light (e.g., red, blue, green, etc.) when energized. In some implementations, an LED 124 may emit an infrared light when energized. In this way, the light may only be visible to a third party utilizing a device capable of seeing infrared light (e.g., a night vision device).

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A helmet mounted lighting system comprising:

a housing comprising a mounting plate and a cover, the housing is configured to encase an electronic circuit, the electronic circuit comprises a power source, a switch, a capacitor, a logic board, and at least one light emitting diode;

wherein:

a bottom side of the mounting plate is contoured for attachment to a curved exterior surface of a helmet;

a top side of the mounting plate includes a receptacle thereon configured to receive the power source therein, the receptacle comprises a sidewall extending upwardly from the top side of the mounting plate, a top side of the sidewall includes a ledge thereon, the ledge is configured to support at least a portion of a printed circuit board on which the switch, the capacitor, the at least one light emitting diode, and the logic board are located;

the switch is configured to selectively energize the at least one light emitting diode;

the logic board, in conjunction with the switch, is configured to control the operation of the at least one light emitting diode; and the capacitor is configured to regulate the light output of the at least one light emitting diode.

2. The helmet mounted lighting system of claim 1, wherein the power source is at least one battery.

3. The helmet mounted lighting system of claim 1, wherein the cover of the housing is flexible.

4. The helmet mounted lighting system of claim 3, wherein the cover of the housing includes an indentation thereon; wherein the switch of the electronic circuit is positioned below the indentation of the cover; and wherein the switch of the electronic circuit is toggled by depressing the cover of the housing inwardly until the cover makes contact with the switch.

5. A helmet mounted lighting system comprising:

a housing comprising a mounting plate and a cover, the housing is configured to encase an electronic circuit, the electronic circuit comprises a power source, a switch, a capacitor, and at least one light emitting diode;

wherein:

a bottom side of the mounting plate is contoured for attachment to a curved exterior surface of a helmet;

a top side of the mounting plate includes a receptacle thereon configured to receive the power source therein, the receptacle comprises a sidewall extending upwardly from the top side of the mounting plate, a top side of the sidewall includes a ledge thereon, the ledge is configured to support at least a portion of a printed circuit board on which the switch, the capacitor, and the at least one light emitting diode are located;

the switch is configured to selectively energize the at least one light emitting diode; and the capacitor is configured to regulate the light output of the at least one light emitting diode.

6. The helmet mounted lighting system of claim 5, wherein the power source is at least one battery.

7. The helmet mounted lighting system of claim 5, wherein the cover of the housing is flexible.

8. The helmet mounted lighting system of claim 7, wherein the cover of the housing includes an indentation thereon; wherein the switch of the electronic circuit is positioned below the indentation of the cover; and wherein the switch of the electronic circuit is toggled by depressing the cover of the housing inwardly until the cover makes contact with the switch.

9. A helmet mounted lighting system comprising:

a housing comprising a mounting plate and a cover, the housing is configured to encase an electronic circuit, the electronic circuit comprises a power source, a switch, a capacitor, and at least one light emitting diode;

wherein:

a bottom side of the mounting plate is contoured for attachment to a curved exterior surface of a helmet;

a top side of the mounting plate includes a receptacle thereon configured to receive the power source therein, the receptacle comprises a cylindrical sidewall extending upwardly from the top side of the mounting plate, a top side of the sidewall includes an annular ledge thereon, the annular ledge is configured to support at least a portion of a printed circuit board on which the switch, the capacitor, and the at least one light emitting diode are located;

the switch is configured to selectively energize the at least one light emitting diode; and the capacitor is configured to regulate the light output of the at least one light emitting diode.

10. The helmet mounted lighting system of claim 9, wherein the power source is at least one battery.

11. The helmet mounted lighting system of claim 9, wherein the cover of the housing is flexible.

12. The helmet mounted lighting system of claim 11, wherein the cover of the housing includes an indentation thereon; wherein the switch of the electronic circuit is positioned below the indentation of the cover; and wherein the switch of the electronic circuit is toggled by depressing the cover of the housing inwardly until the cover makes contact with the switch.

13. The helmet mounted lighting system of claim 9, wherein the electronic circuit further comprises a logic board; and wherein the logic board, in conjunction with the switch, is configured to control the operation of the at least one light emitting diode.

* * * * *